US010062534B2

(12) United States Patent
D'Ippolito et al.

(10) Patent No.: US 10,062,534 B2
(45) Date of Patent: Aug. 28, 2018

(54) DISCONNECTOR AND SURGE ARRESTER INCLUDING SUCH DISCONNECTOR

(71) Applicants: ZOTUP S.R.L., Bergamo (IT); Gianfranco D'Ippolito

(72) Inventors: Gianfranco D'Ippolito, Bergamo (IT); Andrea Passavanti, Bergamo (IT)

(73) Assignee: ZOTUP S.R.L., Bergamo (IT)

( * ) Notice: Subject to any disclaimer, the term of this patent is extended or adjusted under 35 U.S.C. 154(b) by 0 days.

(21) Appl. No.: 15/746,349

(22) PCT Filed: Jul. 19, 2016

(86) PCT No.: PCT/EP2016/067124
§ 371 (c)(1),
(2) Date: Jan. 19, 2018

(87) PCT Pub. No.: WO2017/013092
PCT Pub. Date: Jan. 26, 2017

(65) Prior Publication Data

US 2018/0211805 A1 Jul. 26, 2018

(30) Foreign Application Priority Data

Jul. 20, 2015 (IT) ..... UB2015A2327

(51) Int. Cl.
*H01C 7/10* (2006.01)
*H01H 71/10* (2006.01)
(Continued)

(52) U.S. Cl.
CPC ..... *H01H 71/10* (2013.01); *H01C 7/12* (2013.01); *H01H 33/82* (2013.01); *H01H 71/08* (2013.01); *H01H 2235/01* (2013.01)

(58) Field of Classification Search
CPC . H01C 7/12; H01C 7/10; H01C 7/102; H01C 7/108; H01H 71/10; H01H 71/08; H01H 2235/01
(Continued)

(56) References Cited

U.S. PATENT DOCUMENTS 5,130,884 A * 7/1992 Allina ..... H01R 13/6666 338/21
5,608,596 A * 3/1997 Smith ..... H01C 1/14 361/111
(Continued)

FOREIGN PATENT DOCUMENTS

DE 10 2006 042028 B3 9/2007
EP 2725588 A1 4/2014
(Continued)

OTHER PUBLICATIONS

International Search Report, dated Oct. 11, 2016, from corresponding PCT application No. PCT/EP2016/067124.

*Primary Examiner* — Kyung Lee
(74) *Attorney, Agent, or Firm* — Young & Thompson

(57) ABSTRACT

A disconnector and related surge arrester include first and second connection terminals connecting to active electrical leads, between which a protection element is inserted, having electrodes electrically connected to the connection terminals, a disconnector between the first terminal and an electrode of the protection element including a metal plate having a base end electrically connected to the first terminal and a distal end maintained electrically connected to the electrode, the plate being able to sublimate in the presence of short-circuit currents above a preset threshold, an intercepting slider, mounted longitudinally slidable along a longitudinal direction which lies between the base end of the lamina and the electrode of the protection element to intersect development of an electric arc, a sliding guide for the
(Continued)

intercepting slider, the slider being biased in the longitudinal direction, through a preloaded elastic unit, towards an intercepting position abutting a portion of the plate.

20 Claims, 2 Drawing Sheets

(51) Int. Cl.
*H01C 7/12* (2006.01)
*H01H 33/82* (2006.01)
*H01H 71/08* (2006.01)

(58) Field of Classification Search
USPC ..... 338/21, 13
See application file for complete search history.

(56) References Cited

U.S. PATENT DOCUMENTS 6,094,128 A * 7/2000 Bennett ..... H01C 7/126 338/20
6,430,019 B1 * 8/2002 Martenson ..... H01C 7/126 361/103
RE42,319 E * 5/2011 Martenson ..... H01C 7/126 218/117
8,378,778 B2 * 2/2013 Duval ..... H01C 7/126 338/13
8,502,637 B2 * 8/2013 Guarniere ..... H01C 7/10 338/21
8,836,464 B2 * 9/2014 Wang ..... H01C 7/126 337/401
2007/0200657 A1 * 8/2007 Tsai ..... H01C 1/144 338/21
2009/0121822 A1 * 5/2009 Jeong ..... H01C 7/10 338/20
2009/0161280 A1 * 6/2009 Tseng ..... H01C 7/10 361/103
2011/0170217 A1 7/2011 Mao et al.
2012/0050935 A1 3/2012 Douglass et al.
2012/0105191 A1 * 5/2012 Wang ..... H01C 7/126 337/414
2015/0171622 A1 * 6/2015 Lee ..... H01C 7/126 361/93.7

FOREIGN PATENT DOCUMENTS

EP 2 790 192 A1 10/2014
WO 2007/093572 A1 8/2007

* cited by examiner

Fig. 1B
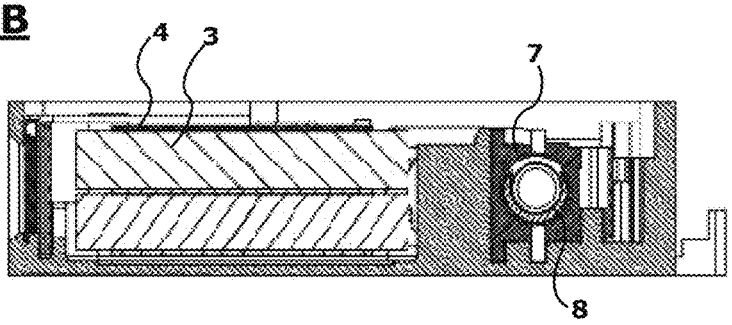
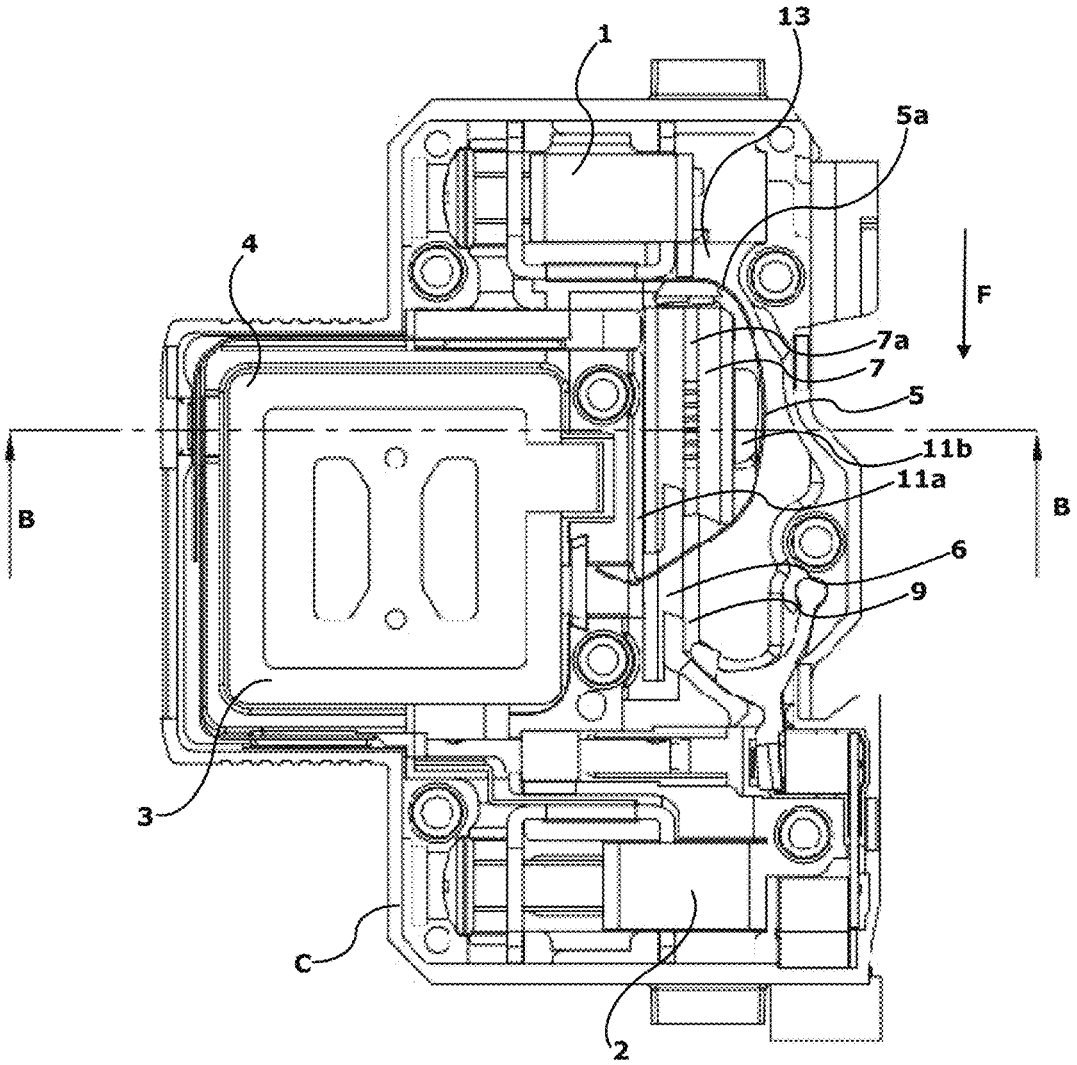
Fig. 1A

DISCONNECTOR AND SURGE ARRESTER INCLUDING SUCH DISCONNECTOR

FIELD OF INVENTION

The present invention relates to a disconnector and relative surge arrester, also called surge limiter, or in brief SPD (Surge Protective Device); in particular it relates to an arrester provided with disconnecting device or disconnector for the interruption of the short-circuit in the event of failure of the SPD.

BACKGROUND ART

By the term surge arrester is meant those electrical/electronic devices which, interposed between the active conductors of the electric system and the ground, provide for the discharging to the ground of the overcurrent/overvoltage peaks—e.g., those generated by atmospheric lightning strikes and switching operations—that might otherwise produce serious damage to the electrical system and its apparatuses.

Indeed, the direct lightning phenomena are the main source of devastating destructive effects on electrical systems; indirect discharges and switching surges are also sources of many damages, the origin of which is not easy to identify, but which effects are equally devastating for the sensitive plants and where the operation continuity is essential. The duration of these phenomena varies from a few microseconds up to a few hundred milliseconds, but in this very short time they convey a very high energy content. These phenomena must be properly intercepted in order to protect the plants connected to the main and thus to ensure the integrity and function thereof.

In this context, reference is made to surge arresters of the most recent prior art, comprising a security element in the form of a varistor, which has an equivalent behaviour to that of a variable (non-linear) resistance in term of voltage/current ratio. In the event of an overshot reference voltage, for example when there is a short-term overvoltage/overcurrent peak, the varistor abruptly lowers its resistance, so that the peak can be easily discharged through it, towards the ground, and does not propagate to other parts of the plant with higher resistance. To the electrodes of the varistor the contacts of the connection terminals of the surge arrester are joined electrically, which are in turn connected respectively to a phase conductor and to the protective conductor and/or the neutral conductor. In the internal circuit of the arrester, disposed in series with the protection element as a varistor, a "disconnector" is typically provided, which is a complex disconnecting device known per se, having protective functions in case of failure and/or degradation of the protection element.

The thermal disconnector is substantially constituted by an electric conductor of various shape connected in series with the electrode of the varistor. It consists of a complex unit, typically comprising an elastic metal plate attached to the electrode of the varistor by welding with a low melting solder dot, which is a material capable of melting at relatively low temperatures (120-180° C.). The elastic plate is welded in an elastically flexed or spring-loaded condition, however placed in a resiliently loaded condition such as to define a bias, which tends to distance it from the electrode of the varistor. Thanks to this arrangement when, as a result of degradation, the varistor starts to discharge to the ground a significant current, which is not transient but continuous in nature, this tends to heat up by Joule effect. This temperature is transferred to the solder dot, and when the temperature of the low melting alloy is reached, the holding capacity of the solder dot is impaired, so as to free the metal plate from the contact with the electrode of the varistor, thus opening the electrical circuit and restoring the safety conditions.

Within certain range of short-circuit current, typically a few tens of amperes, the disconnection system within the arrester is therefore able to perform this disconnection in an autonomous way, i.e. without using other internal or external devices placed in series with the arrester itself.

However, when the internal impedance of the arrester suddenly reaches values close to zero and as a result a short-circuit is generated, it occurs a high-intensity current, which gives rise to an unacceptable condition within the electrical system.

Consequently, a disconnecting device must intervene in order to eliminate this condition. Note, however, that the disconnection obtained with a standard disconnector is not always sufficient. In fact, it should be considered that at the opening of an electric circuit where current is flowing, an electric arc could be created, which seeks to maintain the continuity of the circuit itself. If the arc does not extinguishes by itself or the disconnector is not able to stop it, it creates a dangerous situation both in the arrester (overheating and possible fire and/or explosion) and in the relevant electric plant.

Typically, in the past, devices capable of interrupting significant short-circuit currents, of the order of kArms, were constituted by a overcurrent protection, for example a fuse or a circuit breaker, placed in series with the arrester itself.

More recently, it has been provided a very effective solution, described in EP2790192 in the name of the same Applicant, in which one device includes the disconnection capacity to face slow degradation of the varistor, but also circuit opening means with relative self-extinguishing capability to cope with important short-circuit currents.

This system turned out satisfactory, but the Applicant has noted that there is room for improvement of performance.

In brief, the arrester described in EP2790192 comprises a disconnector, consisting of a flexible metal plate made of conductive material with a geometry such that, in normal operating conditions, maintains an interception slider constrained thereon; the latter has the shape of a slider or mobile carriage with a suitable geometry to intercept and stop the electric arc that would be present during the short-circuit; in a suitable longitudinal recess of the slider a preloaded spring is inserted, suitable to provide the pushing energy to the slider during its operation, which is maintained in compression by the presence of the disconnector itself, which acts as a constraint means.

When high short-circuit currents happen, interruption of the circuit takes place by the fact that the metal plate of the disconnector sublimates, so as to free the slider that in turn intercepts and stops the possible formed electric arc.

However, it was found that the sublimation of the conductive plate generates two effects: on the one hand, the desired effect of elimination of the constrain means holding the slider in its normal operating position, so that the slider is free to move due to the transformation of the potential elastic energy of the spring into kinetic energy; but, on the other hand, the non-desired effect of formation of a conductive gaseous mass, called plasma, which, along with the mains voltage, results in the triggering and the diffusion of the electric arc within the entire arc chamber, i.e., the cavity between the solder dot of the disconnector and the residual root portion of the metallic plate.

In summary, the development of the plasma in the arc chamber causes an instantaneous rise in temperature and pressure.

At the same time, the release of the slider triggers the process that leads to the extinction of the electric arc (well described in EP2790192), but such operation must take place in a sufficiently fast manner so as to prevent the pressure and temperature from being excessively high within the device, up to create explosive effects.

It was found that as the short-circuit current increases, the only potential elastic energy of the spring may be insufficient to impart a thrust to the slider such as to reduce the actuation time and then extinguish the electrical arc in a time span compatible with the mechanical strength of the arrester housing.

In particular, it was noted that the high pressure of the plasma generated by the electric arc exerts on the front end surface of the slider a longitudinal counterthrust, with a direction opposite that produced by the spring, which opposes the movement of the slider. So long as this pressure produces this counterthrust, the slider, although urged by the spring, is not able to move in a manner rapid enough to extinguish the arc within a time span compatible with the mechanical strength of the device housing. The criticality of the phenomenon is inherent in the fact that the counterthrust generated by the plasma pressure increases with the square of the short-circuit current; vice versa, the thrust exerted by the spring is an invariant with respect to this current.

This phenomenon is not mitigated adequately even by the provision of pressure evacuation holes pierced in the slider guide chamber on the back side of the slider itself.

Other arrangements of surge arresters are disclosed also in US20110170217, WO2007/093572, DE102006042028, US20120050935 and EP2725588, but none of them is supplying any useful suggestion to address the above cited technical problems.

SUMMARY OF THE INVENTION

The object of the invention is therefore to supply a disconnector that solves the problems of the prior art; namely, it is needed to provide a disconnector in a surge arrester that, without losing all the functional advantages of providing a sublimable internal lamina and a slider for the electric arc shut-off, allows to avoid that the pressure of the plasma, produced by the sublimation of part of the disconnector itself, approaches limits that are dangerous for the life of the arrester.

This object is achieved through the features set out in essential terms in the appended claims.

BRIEF DESCRIPTION OF THE DRAWINGS

Further features and advantages of the invention will anyhow be more evident from the following detailed description of a preferred embodiment, given as a non-limiting example and illustrated in the accompanying drawings, wherein:

FIG. 1A is a schematic side elevation view, with parts cut away, of a surge arrester in an armed condition and with disconnector at rest;

FIG. 1B is a cross-section view taken along line B-B of FIG. 1A; and,

DETAILED DESCRIPTION OF A PREFERRED EMBODIMENT

Figure 2:
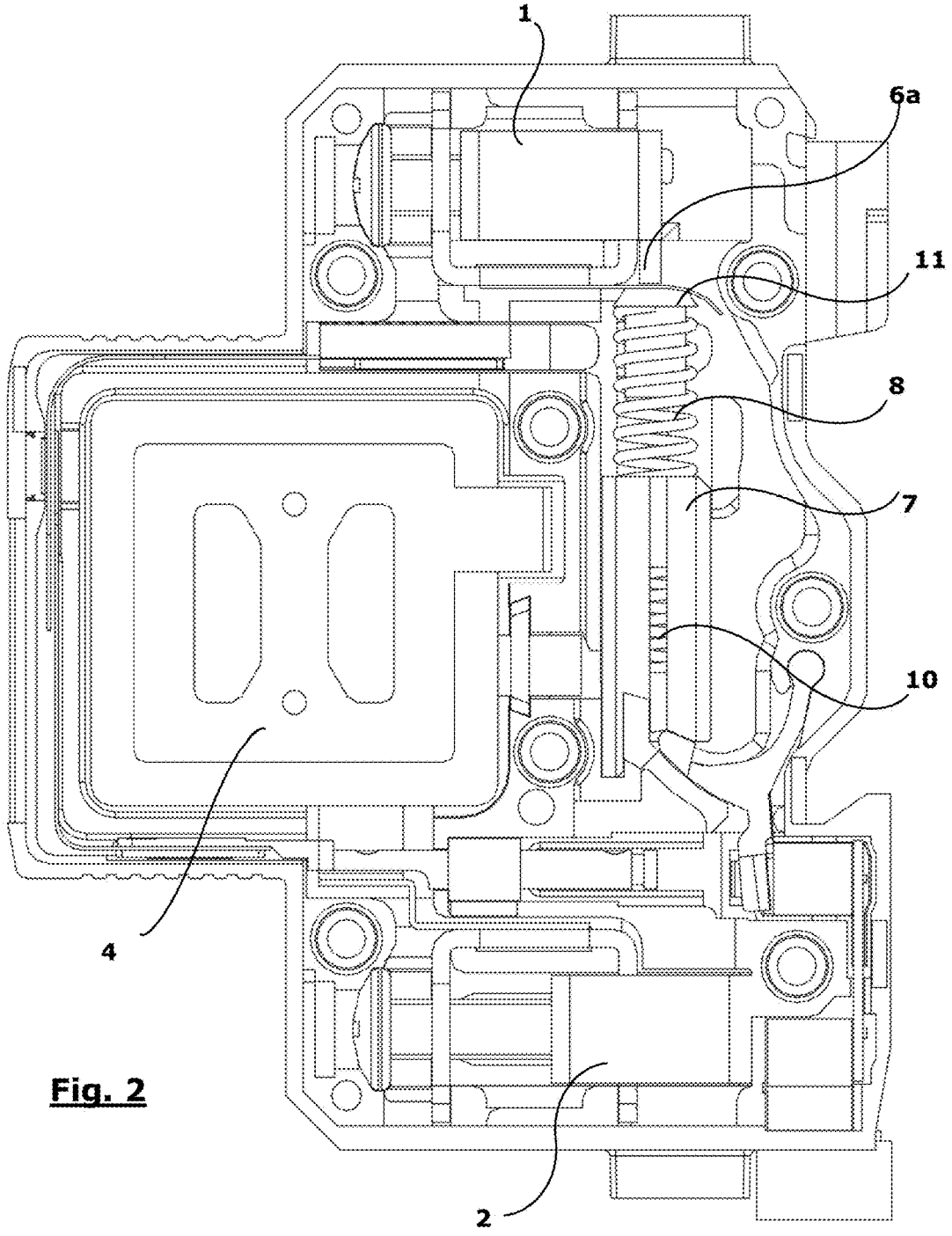
FIG. 2 is a view similar to that of FIG. 1, of a surge arrester according to the invention, in a state in which the disconnector has reached the end of stroke and completed the opening of the circuit.

In FIG. 1 there is shown a configuration of a surge arrester known per se from EP2790192, which here is considered included as reference.

A surge arrester is housed in a box-shaped body or housing, referenced as module C, with dimensions such as to be housed in a single standard module and wired inside a switchboard for electrical plants. In this housing C, in a per se known manner, two opposing terminals are accommodated—a first terminal 1 for the connection of the phase lead and a second terminal 2 for the connection of the protective, or neutral, lead—between which a protection element (typically a varistor) is arranged, here schematized by a plate 3, on whose opposing surfaces the respective conducting electrodes are arranged (in the figures only an electrode 4 is illustrated, the other being on the opposite side is not visible in the drawing).

The electrode 4 is electrically connected to the phase terminal 1, while the opposed electrode is connected to the ground or neutral terminal 2. The connection between the electrode 4 (FIG. 1A) and terminal 1 is realized by a conductor constituting an element of the disconnector. In particular, this conductor of the disconnector is in the form of a flexible lamina or plate 5, which is elastically preloaded and joined to the electrode 4 by a suitable low-melting solder dot at the point marked with 5*d*.

The material used to make the low-melting solder and the exact configuration of the flexible plate is not relevant in this context and not be described here in further detail.

The flexible plate 5 is preferably made of a low thickness (in the order of a few tenths of a millimeter, for example 0.2-0.3 mm) and a reduced section, with a metallic material having conductive properties equal or lower to that of copper.

In case it is used a material having lower conductive properties (=conductivity rate), the thickness can be increased for example up to 0.5-1 mm. An exemplary conductivity rate can be a IACS (International Annealed Copper Standard)<60; in this case, the material is preferably made from a copper alloy with elements such as to modify its conductivity (copper IACS <90) and confer elastic properties.

Such a plate is advantageously conceived to sublimate rapidly—namely passing from solid to gaseous state—when run by short-circuit currents above a preset amount of current, of the order of a few kArms, e.g. from 3 up to 16 (indicative but not binding values).

Between the abutment rigid wall of the plate 5 (FIG. 1A) and an inner housing for accommodating the varistor 3, it is defined a guide 6 where a slider 7 is sliding accommodated for the interception and compression of the arc. In particular, the slider 7 is longitudinally guided by two parallel containment walls 11*a* and 11*b*. In addition, preferably, the slider 7 is provided with a pair of longitudinal grooves 7*a*, on the two opposite sides, intended to engage and slide on corresponding longitudinal ribs 9 arranged within the guide 6.

The slider 7 is mounted to slide longitudinally within the guide 6 while being constrained in rest conditions (represented in FIG. 1A), on one side against a bottom wall 13 of the guide 6 and, on the other side, on a part of the flexible plate 5. The slider 7 is mounted being biased toward (arrow F) the plate 5 by means of an elastic element, such as a spring 8 (visible in FIG. 2), which is mounted pre-compressed between the bottom wall 13 and the body of the slider 7.

In particular, to exploit the interior space of the device, the slider 7 has a longitudinal cavity, in which a major part of the spring 8 is inserted.

Preferably, the slider 7 is made as a tubular body, closed at one front end (the lower end in the drawing) and opened at the other back end.

With this construction, the slider 7 is retained by the plate portion 5, which is abutting on the front end and which is opposing to the thrust of the spring 8.

Instead, when the retaining action of the plate 5 is released, as a result of its sublimation resulting from the short-circuit current, the slider 7 is released and pushed by the spring 8 in the direction of the arrow F, so as to perform its electric arc extinguishing function and ending its run in abutment against an end wall.

Note that the slider 7 must have a significant length, for example of the order of some tens of mm, because it must ensure an adequate area of contact with the containment and guide walls 11*a* and 11*b* as well as a high creepage distance favourable to the arc extinguish function. Due to the necessary sliding clearance between the slider 7 and the walls 11*a* and 11*b*, if the creepage distance is not sufficiently extended, there would be a high risk that the electric arc can remain switched on between the slider 7 and the guide walls 11*a* and 11*b*, circulating around the slider which would be not more effective for the arc extinction. Therefore, it is appropriate that the side walls of the slider, those perpendicular to the direction of propagation of the electric arc, are extended as much as possible.

This significant length of the slider causes in part the problems arising from the development of plasma, because the pressure front of the plasma has to travel a long way before reaching the back side of the slider and re-balancing the thrust that is generated on the front side opposing to the spring 8: as a result, the timing of the action of the slider are getting longer, and there is the risk of explosion of the device due to the greater energy developed inside the casing.

According to the invention, this problem is solved by providing in either or both opposite walls of the tubular body of the slider 7 one or more openings 10 (visible in FIG. 2), which put in communication the environment outside the slider with the environment within its longitudinal cavity housing the spring 8.

In this way, when the plasma diffuses into the arc chamber, the pressure front reaches and enters, through the openings 10, the longitudinal cavity of the slider 7 so as to automatically and immediately determine a re-balancing of the pressures acting on the front end surface of the slider 7: this is an advantageous condition in order that the potential elastic energy of the slider spring is no longer hampered by the plasma pressure and can perform in short time its effectiveness in moving the slider in the working direction F.

To avoid adverse effects on the creepage distance between the slider and guide walls, which has the effect indicated above, preferably said openings 10 are located on the upper and lower sides (i.e. those parallel to the lying plane of the annexed drawings) of the slider having a quadrilateral section. In other terms, the openings 10 are placed on the sides parallel to the extending path of the plate, which is the path on which the electric arc is propagated naturally.

Still more preferably, the openings 10 are in the form of narrow slits located within the opposed grooves 7*a*, as clearly shown in FIG. 2.

In this way, the plasma pressure front is directly channelled by the grooves 7*a*, enters within the cavity of the slider 7 through the openings 10 and, on one hand, it balances the pressure on the front surface of the slider 7 (allowing an effective action of the spring 8) and, on the other, by raising the pressure inside the slider 7, it creates an reaction effect with a direction according to the arrow F, being able only to escape towards the rear side, which further assists the desired propulsion of the slider 7.

In fact, the hot gases generated by the electric arc conveyed through the feed channels into the inner chamber of the slider, tend to expand naturally according to a phenomenon similar to the expansion of the gases inside the cylinder of an internal combustion engine.

The thrust generated by the expansion of the gases is suitably exploited to speed up the slider by means of a construction that suitably guides the escape of the gases. According to a further preferred feature of the invention, it is in fact provided a valve body 11, similar to a check valve, placed on the back of the slider and forming a support for the rear end of the spring 8. The valve 11 is maintained by the spring 8 in abutment on a nozzle 6*a* for venting the exhaust gases to the outside, formed on an abutment wall of the housing C, preventing the escape of the gases from the cavity of the slider 7 before they have completed their rebalancing and thrusting function on the slider itself.

Preferably, the valve 11 is in the form of a poppet body, whose shank is inserted between the coils of the spring 8.

The system thus conceived is therefore able to adequately convey the plasma under pressure and transform part of the problem (i.e. the huge plasma pressure energy) in the solution of the same.

Compared to the spring 8, which is able to exert a force not variable with respect to the pressure, this adjuvant effect of the plasma—as long as it is within the limits of the mechanical strength of the whole system—is advantageously a function of the square of the current: the higher the short-circuit current and the resulting arc pressure, the greater the thrust exerted by hot gases on the slider in the direction that allows the arc extinction.

In conclusion, the internal disconnection system on the arrester allows realizing the extinction of the short-circuit current through the combination of the following three principles:

- plasma thermodynamics in the inner chamber of the slider: the plasma entering the inner cavity or chamber of the slider allows the rebalancing of the pressures by creating the conditions for a timely intervention of the slider itself; furthermore, the hot gas expansion provides an additional thrust to that exerted by the preload spring;
- dynamics due to the shape of the slider: the slider movement stretches and compresses the electric arc, forcing it into a constrained path;
- electric arc electrodynamics: the elongation and the compression of the electric arc raise its electrical resistance and consequently its voltage up to match the voltage of the driving energy (i.e., mains voltage) resulting in a rapid decrease of the short-circuit current until its extinction.

As is well understood from the above description, the configuration of the invention, despite its simplicity, is extremely effective for the safe shut-down of the arc by the disconnector apparatus, even in the presence of high short-circuit currents, which in turn develop an important amount of conductive plasma resulting from the sublimation of the conductive plate.

It is understood, however, that the invention is not to be considered as limited by the particular arrangement illustrated above, which represents only an exemplary implementation of the same, but different variants are possible either inside or outside of the arrester, all within the reach of a person skilled in the art, without departing from the scope of the invention itself, as defined by the following claims.

For example, the device above described is sized to be coordinated with any overcurrent limiters which should be required in the case the short-circuit current (Isc) of the plant is greater than the self-extinction capacity of the mains current (Ifi) of the disconnection device of the SPD.

In addition, the disconnection device (disconnector) as described above can also be implemented in a special enclosure (housing) and used as an independent short-circuit switching device, regardless of the presence of a surge arrester.

The invention claimed is:

1. Surge arrester, comprising a first and a second connection terminals (1, 2) for connection to the active leads of an electric plant, between which a protection element (3) is inserted, provided with a pair of electrodes (4) electrically connected to said connection terminals, a disconnector arranged between said first terminal (1) and an electrode (4) of the protection element (3) comprising a metal plate (5) having a base end (5*a*) electrically connected to said first terminal (1) and a distal end maintained electrically connected to said electrode (4), said lamina (5) being made of a material and section suited to cause it to sublimate in the presence of short-circuit currents above a preset threshold, an intercepting slider (7), mounted longitudinally slidable along a longitudinal direction which lies between said base end (5*a*) of the plate (5) and said electrode (4) of the protection element (3) to intersect development of an electric arc, a sliding guide (6) for said intercepting slider (7), the slider being biased in said longitudinal direction, through preloaded elastic means (8), towards an intercepting position abutting a portion of said plate (5), wherein said slider (7) is in the shape of a hollow, elongated body, open at a back end and closed at a front end, and partly houses said preloaded elastic means (8), and wherein said slider (7) is provided with at least one opening (10), on the side wall of said hollow body, which runs through the thickness thereof and puts in communication the outside with the inside of said hollow, elongated body of the slider (7).

2. Surge arrester as in claim 1, wherein said opening (10) is in the shape of a narrow, longitudinally elongated opening.

3. Surge arrester as in claim 2, wherein said opening (10) is obtained in a longitudinal groove (7*a*) of said slider (7) with which a guiding rib (9) of said sliding guide (6) is apt to engage.

4. Surge arrester as in claim 3, wherein a valve body (11) is provided between a rear end of said elastic means (8) and a fixed abutment integral with said sliding guide (6) provided with a gas discharge nozzle (6*a*).

5. Surge arrester as in claim 3, wherein said slider (7) has a quadrilateral crosswise section and said openings (10) are only on sides of the slider (6) substantially parallel to a connecting path of said metal plate (5).

6. Surge arrester as in claim 2, wherein a valve body (11) is provided between a rear end of said elastic means (8) and a fixed abutment integral with said sliding guide (6) provided with a gas discharge nozzle (6*a*).

7. Surge arrester as in claim 2, wherein said slider (7) has a quadrilateral crosswise section and said openings (10) are only on sides of the slider (6) substantially parallel to a connecting path of said metal plate (5).

8. Surge arrester as in claim 1, wherein a valve body (11) is provided between a rear end of said elastic means (8) and a fixed abutment integral with said sliding guide (6) provided with a gas discharge nozzle (6*a*).

9. Surge arrester as in claim 8, wherein said slider (7) has a quadrilateral crosswise section and said openings (10) are only on sides of the slider (6) substantially parallel to a connecting path of said metal plate (5).

10. Surge arrester as in claim 1, wherein said slider (7) has a quadrilateral crosswise section and said openings (10) are only on sides of the slider (6) substantially parallel to a connecting path of said metal plate (5).

11. Disconnector for short-circuit overcurrents, comprising a first and a second terminal (1, 2) for connection to the active conductors of an electric system, a metal plate (5) having a base end (5*a*) electrically connected to said first terminal (1) and a distal end maintained electrically connected to said second terminal (2), said plate (5) being made of a material and section suited to cause it to sublimate in the presence of short-circuit cur-rents above a preset threshold, an intercepting slider (7), longitudinally slidably mounted along a longitudinal direction which lies between said base end (5*a*) of the plate (5) and said second terminal (2) to intersect development of an electric arc, a sliding guide (6) for said intercepting slider (7), the slider being biased in said longitudinal direction, through preloaded elastic means (8), to-wards an intercepting position abutting a portion of said plate (5), wherein said slider (7) is in the shape of a hollow, elongated body, open at a rear end and closed at a front end, and partly houses said preloaded elastic means (8), and wherein said slider (7) is provided with at least one opening (10), on the side wall of said hollow body, which runs through the thickness thereof and puts in communication the outside with the inside of said hollow elongated body of the slider (7).

12. Disconnector as in claim 11, wherein said opening (10) is in the shape of a narrow, longitudinally elongated slot.

13. Disconnector as in claim 12, wherein a valve body (11) is provided between a rear end of said elastic means (8) and a fixed abutment integral with said sliding guide (6) provided with a gas discharge nozzle (6*a*).

14. Disconnector as in claim 12, wherein said slider (7) has a quadrilateral crosswise section and said openings (10) are only on sides of the slider (6) substantially parallel to the connecting path of said plate (5).

15. Disconnector as in claim 11, wherein said opening (10) is obtained in a longitudinal groove (7*a*) of said slider (7) with which a guiding rib (9) of said sliding guide (6) is apt to engage.

16. Disconnector as in claim 15, wherein a valve body (11) is provided between a rear end of said elastic means (8) and a fixed abutment integral with said sliding guide (6) provided with a gas discharge nozzle (6*a*).

17. Disconnector as in claim 15, wherein said slider (7) has a quadrilateral crosswise section and said openings (10) are only on sides of the slider (6) substantially parallel to the connecting path of said plate (5).

18. Disconnector as in claim 11, wherein a valve body (11) is provided between a rear end of said elastic means (8) and a fixed abutment integral with said sliding guide (6) provided with a gas discharge nozzle (6*a*).

19. Disconnector as in claim 18, wherein said slider (7) has a quadrilateral crosswise section and said openings (10) are only on sides of the slider (6) substantially parallel to the connecting path of said plate (5).

20. Disconnector as in claim 11, wherein said slider (7) has a quadrilateral crosswise section and said openings (10) are only on sides of the slider (6) substantially parallel to the connecting path of said plate (5).

* * * * *